United States Patent [19]

Uzaki et al.

[11] 4,230,172

[45] Oct. 28, 1980

[54] MOLDING APPARATUS WITH A COMPRESSED AIR SQUEEZE PLATE

[75] Inventors: Nagato Uzaki, Toyokawa; Yasutaro Kawamura, Okazaki; Kimikazu Kaneto, Toyokawa; Masaharu Hasizume, Chiryu, all of Japan

[73] Assignee: Sintokogio Ltd., Nagoya, Japan

[21] Appl. No.: 60,861

[22] Filed: Jul. 26, 1979

[30] Foreign Application Priority Data

Mar. 8, 1979 [JP] Japan ..... 54-27561

[51] Int. Cl.[3] ..... B22C 15/28

[52] U.S. Cl. ..... 164/192; 164/195; 164/212

[58] Field of Search ..... 164/12, 37, 38, 40, 164/192, 193, 195, 200, 201, 207, 212

[56] References Cited

U.S. PATENT DOCUMENTS

| | | | |
|---|---|---|---|
| 3,200,449 | 8/1965 | Hatch | 164/193 |
| 3,659,642 | 5/1972 | Vasilkovsky et al. | 164/37 |

FOREIGN PATENT DOCUMENTS

| | | | |
|---|---|---|---|
| 447142 | 3/1948 | Canada | 164/212 |
| 44-20443 | 9/1969 | Japan | 164/212 |
| 54-35123 | 3/1979 | Japan . | |
| 54-38220 | 3/1979 | Japan . | |
| 425718 | 10/1974 | U.S.S.R. | 164/38 |

*Primary Examiner*—Robert D. Baldwin
*Attorney, Agent, or Firm*—Armstrong, Nikaido, Marmelstein & Kubovcik

[57] ABSTRACT

A molding apparatus having a pattern plate provided with vent through bores, a mold flask adapted to be placed on the pattern plate, an up-set frame adapted to be carried by the mold flask, a cover plate covering the upper end opening of the up-set frame, a squeeze plate disposed in the cover and movable into the up-set frame, and compressed air supplying means adapted to introduce compressed air into the space in the mold flask. After filling the space in the mold flask with the molding sand, the compressed air is introduced into the space in the mold flask by means of the compressed air supplying means. The air flows through the molding sand toward the vent through bores formed in the pattern plate so that the molding sand particles are packed and consolidated in the area around the vent through bores. Then, a squeezing is effected on the molding sand by mechanically or pneumatically depressing the squeeze plate so as to form a mold having sufficient molding condition and even compactness, without necessitating jolting action which has been indispensable in the conventional molding apparatus.

10 Claims, 4 Drawing Figures

45
48
43
42
46
41
47
30
50
51
31
25
58
57
37
33
38
26
23
24
34
32
39
40
35
18
21
21
19
19
20
20
22
36
17
9
10
7
8
12
16
15
11
5
5
4
4
6
14
13
3
13
14
1
2
A

MOLDING APPARATUS WITH A COMPRESSED AIR SQUEEZE PLATE

BACKGROUND OF THE INVENTION

The present invention relates to a molding apparatus for forming a mold by filling a mold flask with molding sand, allowing a compressed air to pass through the molding sand to consolidate the molding sand on the surface of a pattern plate, and imparting a squeezing action to the whole part of the molding sand in the mold flask.

With conventional molding apparatus, it has been difficult to obtain a mold having a predetermined hardness and the molding condition solely by the squeezing action, particularly when the pattern has a complicated shape.

In order to overcome this problem, there has been proposed and used a molding apparatus having a jolting device arranged to effect a jolt on the mold sand before the squeezing action is imparted. This jolting device, however, produces undesirable vibration and noise to adversely affect the environmental condition. In addition, the molding apparatus itself should have a construction strong enough to withstand the jolt imparted thereto, which results in an increased size of the apparatus and, hence, in a larger scale of the foundation work requiring a huge cost of equipment as a whole.

Another disadvantage is that the molding sand near the pattern surface is not effectively squeezed after the molding sand has been subject to the jolt, so that it becomes necessary to increase the squeezing pressure which requires a more expensive squeezing device of a larger power. The increased squeezing pressure, on the other hand, accelerates the wear of the pattern plate unfavourably.

SUMMARY OF THE INVENTION

It is therefore a major object of the invention to provide a molding apparatus capable of forming a mold having a required consolidation and desired molding condition, without necessitating the step of effecting the jolt, thereby to overcome the above-described problem of the prior art.

To this end, according to the invention, there is provided a molding apparatus comprising a pattern plate including a pattern provided with vent bores, means for placing a mold flask above said pattern plate, up-set frame vertically displaceably disposed above the mold flask, a hollow cover having a lower opening and arranged to removably cover the upper opening of the up-set frame, means for lifting and lowering the pattern plate relative to the hollow cover so as to have the hollow cover and the pattern plate cramp therebetween the mold flask and the up-set frame, a squeeze plate provided at the inside of the hollow cover and vertically movable from a position in the hollow cover through the lower opening of the cover, and means capable of communicating with the inside of the hollow cover, for supplying a compressed air into the cramped mold flask through the lower opening of the hollow cover and the up-set frame, when the squeeze plate has been retracted into the hollow cover to allow the lower opening to open.

The above and other objects, as well as advantageous features of the invention will become more clear from the following description of the preferred embodiments taken in conjunction with the accompanying drawings.

DESCRIPTION OF THE PREFERRED EMBODIMENTS

Figure 1:
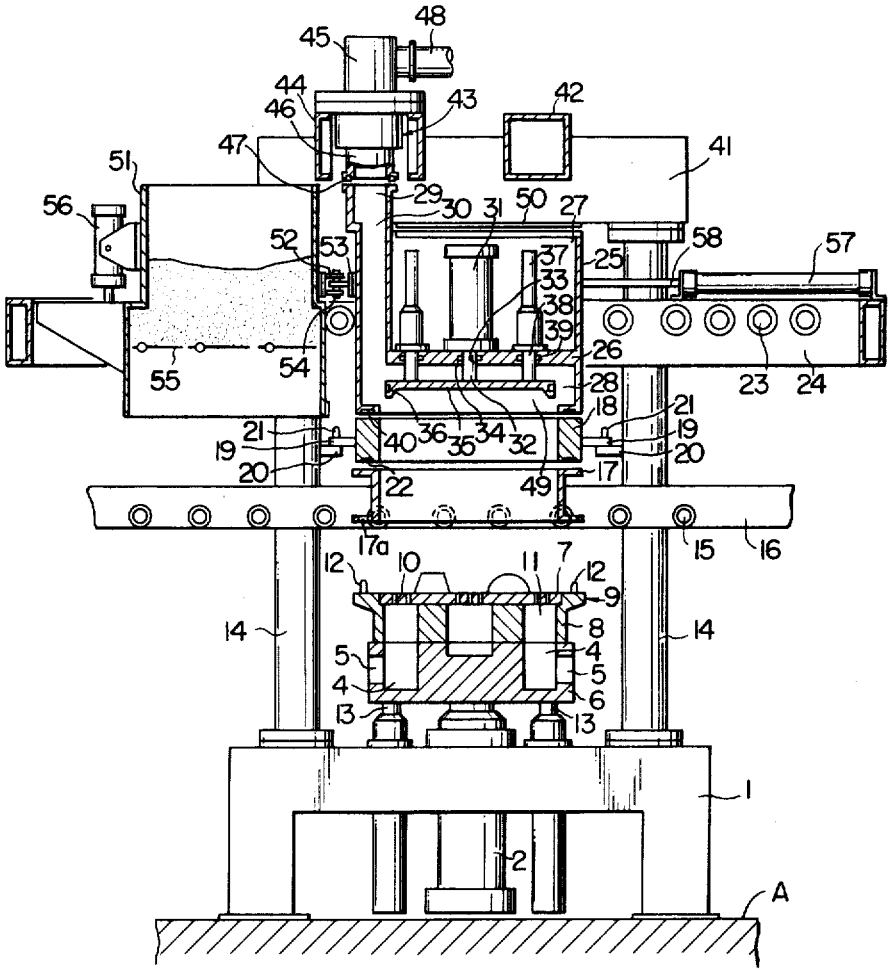
FIGS. 1 to 4 are front elevational sectional views of a molding apparatus in accordance with the invention, in different states of operation.

Referring to the drawings, a reference numeral 1 denotes a base installed on a foundation A. A cylinder 2 mounted on the central part of the base 1 has a piston rod 3 which expand upwardly. A table 6 fixed to the end of the cylinder rod 3 has a recessed cavities 4 opened through its upper surface and is provided in its both side walls with evacuation ports 5 which are in communication with the cavities 4. A pattern plate generally designated at a reference numeral 9 is fixed to the upper surface of the table 6. The pattern plate 9 includes a pattern base 8 and a pattern 7 fixed to the upper surface of the latter. A plurality of vent bores 10 are formed vertically through the pattern 7. Although not shown, a vent plug which allows only the air to pass therethrough, is provided in the upper end portion of each vent bore 10.

The vent bores 10 are disposed in portions where the molding sand is less likely to be subject to the squeezing pressure and, hence, less likely to be packed to the desired hardness or consolidation. The aforementioned vent plugs are so disposed that their upper surfaces are flush with the surface of the pattern 7. The vent bores 10 are communicated with the cavities 4 through cavities 11 formed in the pattern base 8. Guide pins 12 are arranged for correctly locating a later-mentioned mold flask on the pattern plate 9. Guide rods 13 are intended for preventing the table 6 from rotating in a horizontal plane. A column 14 stands up from the base 1 in each of four corners of the latter.

A pair of roller conveyors 16, each having a plurality of flanged rollers 15 disposed at a constant pitch, are extended in the lateral direction and supported by the pairs of the columns 14 at mid points of the latter. The pair of conveyors are spaced from each other in the crosswise direction by a distance which is large enough to allow the table 6 to pass therethrough. A rectangular mold flask 17 is displaceably mounted on the conveyors 16 with its front and rear end portions placed on the flanged rollers 15. An up-set frame designated at the numeral 18 has an inside and outside lengths substantially equal to those of the mold flask 17. The up-set frame 18 is vertically movably carried by brackets 20 which project inwardly from the columns 14 through its laterally extended legs 19 guided by guide pins 21 provided on the brackets 20.

A sealing member 22 is embedded in the lower surface of the up-set frame 18 along the periphery 7 of the up-set frame 18. The lower part of the sealing member 22 projects slightly downwardly from the lower face of the up-set frame so as to provide an airtight seal between the up-set frame 18 and the underlying mold flask 17.

In the state as shown in FIG. 1 in which the legs 19 of the up-set frame 18 are carried by the brackets 20, the lower part of the sealing member 22 is positioned slightly above the upper end of the mold flask 17 carried by the roller conveyors 16 with a predetermined gap preserved therebetween.

A roller conveyor 24 having a plurality of equispaced flanged rollers 23 is disposed above the up-set frame and extends in parallel with the roller conveyors 16. A box-shaped cover member 25 is movably carried by the roller conveyor 24 through its supports (not shown) extending forwardly and rearwardly therefrom. The cover member 25 has a rectangular lower opening portion which is so formed that its inner dimentions are slightly larger than those of the up-set frame 18 and its outer dimentions are substantially equal to those of the up-set frame 18.

The space within the cover member 25 is divided by a partition plate 26 into an upper chamber 27 and a lower chamber 28. In one side of the cover member 25, provided is an air supplying pipe 30 having one end project above the cover member 25 and the other end communicates with the lower chamber 28.

A cylinder 31 attached to the partition plate 26 is arranged to drive a later-mentioned squeeze plate 35 up and down. The cylinder 31 has a piston rod 32 which projects downwardly through a through-bore 33 formed in the partition plate 26. An "O" ring 34 is placed in the through bore 33 to provide an airtight seal between the latter 33 and the piston rod 32.

The aforementioned squeeze plate 35 having a horizontal plate-like form is attached to the lower end of the piston rod 32. The squeeze plate 35 is provided in its peripheral surface with a sealing member 36 through which the squeeze plate 35 is received in an airtight manner by the up-set frame 18. A reference numeral 37 denotes guide members standing up from the upper surface of the squeeze plate 35 which are received in an airtight manner by guide bores 38 formed in the partition plate 26 through "O" rings 39 so as to prevent the squeeze plate 35 from rotating in a horizontal plane. In the lower end surface of the cover member 25, embedded is a sealing member 40 the lower end of which projects downwardly from the lower end surface of the cover member 25 in order to make contact with the upper end of the up-set frame 18 so as to provide an airtight seal therebetween.

In the state as shown in FIG. 1 in which the cover member 25 is carried by the flanged rollers 23 while the up-set frame 18 is carried through its legs 19 by the bracket 20, the sealing member 40 partially embedded in the cover member 25 is positioned slightly above the upper end of the up-set frame 18 to leave a predetermined gap therebetween.

Top frames 41 are extended between the top ends of each pair of the columns 14. The top frames 41 are connected at their mid points to each other by a reinforcing girder 42.

The top frames 41 carry at their one end sides a pressurizing cylinder device 43 through a support member 44. The pressurizing cylinder device 43 mainly consists of a cylinder 45 and a hollow piston rod 46 slidably received by the cylinder 45. The lower end opening of the hollow piston rod 46 is positioned slightly above the upper end opening of the air supplying pipe 30 in the state shown in FIG. 1 in which the cover member 25 is mounted on the flanged roller 23 and the hollow piston rod 46 has been raised. A connection pipe 48 which communicates at its one end to a source of compressed air (not shown) is connected at its other end to the other end of the cylinder 45 through 3-way directional control valve which is also not shown. A sealing member 47 is provided in the lower end surface of the hollow piston rod 46.

The arrangement is such that, when the cylinder 45 is actuated to bring the hollow piston rod 46 into communication with the air supplying pipe 30 and 3-way directional control valve (not shown) is opened, the compressed air is allowed to flow into a space 49 which is defined by the peripheral wall of the squeeze plate 35, the partition plate 26 and the cover member 25, through the connection pipe 48, the cylinder 45, the hollow pistion rod 46 and the air supplying pipe 30. A reference numeral 50 denotes a stopper attached to the lower surface of the top frame 41.

A hopper 51 for supplying the molding sand can hold a batch of molding sand required for one molding operation. This hopper 51 is movably mounted on the flanged rollers 23 of the roller conveyor 24. The hopper 51 has a connecting member 52 extending from the right side surface thereof. This connecting member 52 is connected by a joint pin 54 to a connecting member 53 which project laterally from the left side surface of the cover member 25 so that the hopper 51 is movable on the roller conveyor 24 to the right and left together with the cover member 25. Since the joint pin 54 is slidably received by the bore formed in the connecting member 52, and the cover member 25 can be moved independently from the illustrated position upwardly by a predetermined stroke.

The bottom of the hopper 51 is constituted by a plurality of damper members 55 which are arranged to be rotated by a cylinder 56 to the position for closing the bottom of the hopper 51.

A cylinder 57 mounted on the roller conveyor 24 has a piston rod 58 the end of which is connected to the cover member 25 through a bracket which is not shown. The cover member 25, therefore, is moved to the right and left together with the hopper 51 on the roller conveyor 24 as the cylinder 57 is actuated.

A reference numeral 17 a denote guide bores which are formed in the lower surface of the mold flask 17 so as to oppose to the guide pins 12.

The molding machine of this embodiment having the described construction operates in a manner described hereinunder.

Figure 2:
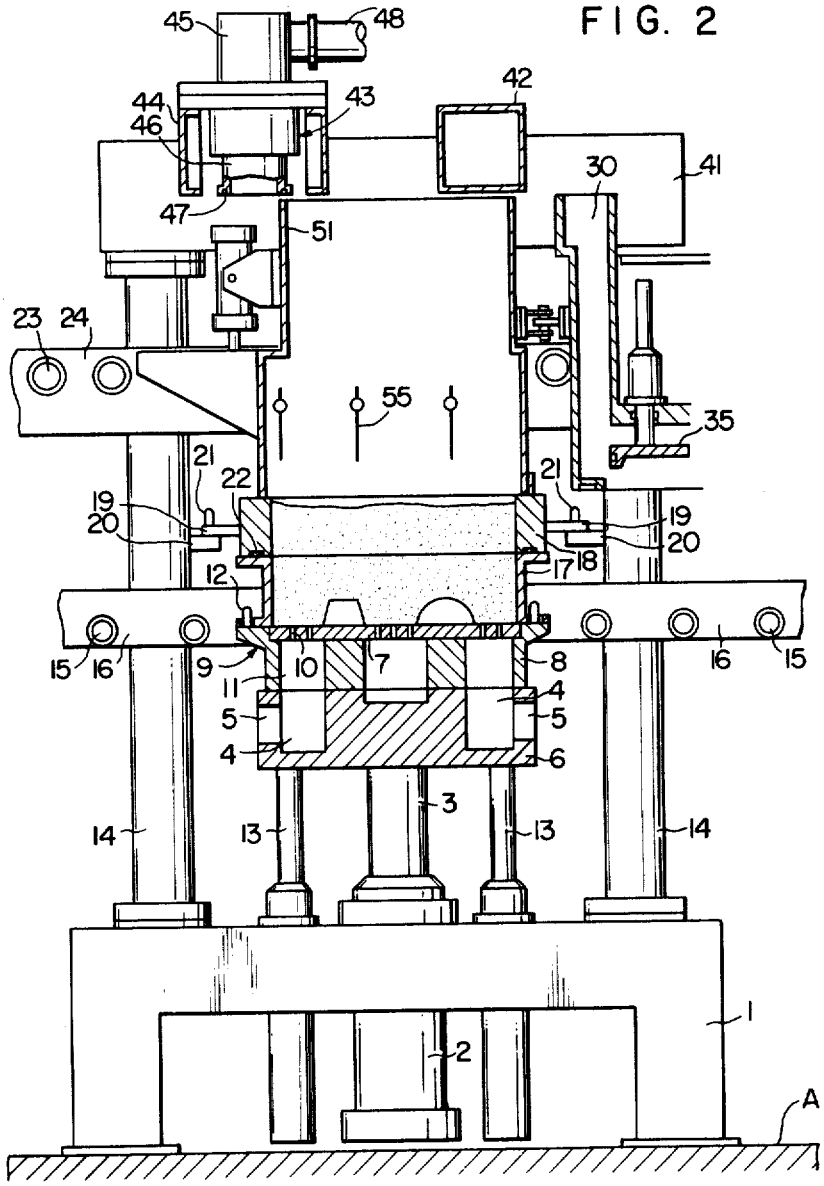

The cylinder 57 is actuated to move the cover member 25 and the hopper 51 rightward from the illustrated position of FIG. 1 so as to place the hopper 51 just above the up-set frame 18 as shown in FIG. 2. Then, the cylinder 2 is energized to lift the table 6 together with the pattern plate 9 so that the guide pin 12 come to be received by the guide bores 17*a*. As the cylinder 2 further works, the mold flask 17 on the roller conveyor 16 is lifted by the pattern plate 9 so as to separate from the roller conveyor 16. A further operation of the cylinder 2 has the mold flask 17 carry and lift the up-set frame 18 through the sealing member 22 placed therebetween.

Immediately before the upper surface of the up-set frame 18 comes into contact with the lower surface of the hopper 51, the cylinder 2 stops to operate and, then, the damper members 55 are swung by the cylinder 56 to open the bottom of the hopper so as to allow the molding sand in the hopper 51 to drop and flow into the mold flask 17 and the up-set frame 18 to fill them. (See FIG. 2)

Figure 3:
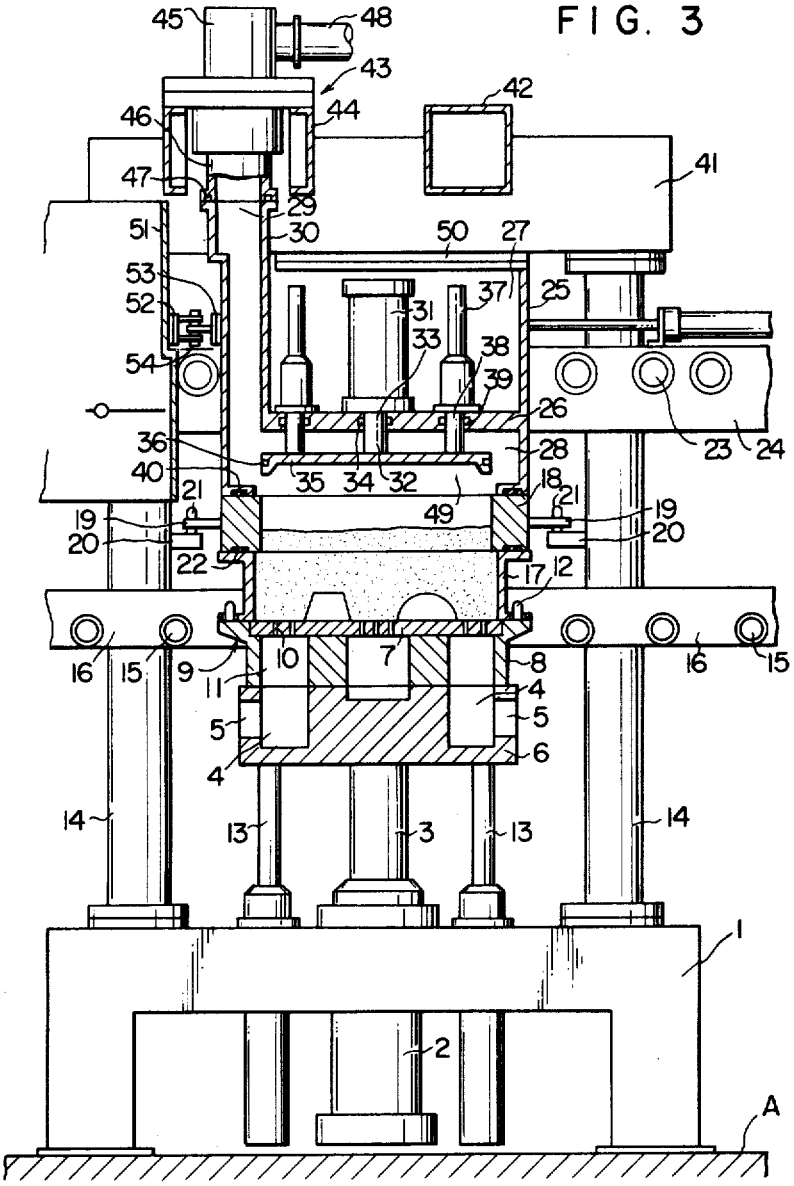

Subsequently, the cylinder 57 is reversed to move the cover member 25 to the position just above the up-set frame 18, and the cylinder 2 is started again to lift the pattern plate 9 on the table 6 together with the mold flask 17 and the up-set frame 18. As the cylinder 2 further operates, the up-set frame 18 comes into contact through the sealing member 40 with the cover member 25 to lift the latter. A further operation of the cylinder 2 brings the upper end of the cover member into contact with the stopper member 50 so that the sealing members 22 and 40 are pressed at their lower ends against the upper surfaces of the mold flask 17 and the up-set frame 18, respectively as shown in FIG. 3. In consequence, a closed space is formed above the pattern plate 9 by the combination of the mold flask 17, the up-set frame 18 and the cover member 25.

Then, the pressurizing cylinder 43 is energized to press the hollow piston rod 46 at the lower end of the latter against the upper end of the air supplying pipe 30 through the sealing member 47 thereby to make the hollow piston rod 46 and the air supplying pipe communicate with each other. As the 3-way directional control valve (not shown) is operated to open the air passage, the compressed air flows into the mold flask 17 and the up-set frame 18 through the air cylinder 45, the hollow piston 46, the air supplying pipe 30 and then through the space which is defined by the peripheral part of the squeeze plate 35, the inner surface of the cover member 25 and the partition plate 26. As a result, the particles of the molding sand is fluidly moved toward the vent bores 10 having vent plugs, the vent bores being disposed at areas where the molding sand is less liable to be pressurized during squeezing operation. Therefore, the molding sand particles are compacted on the surface of the pattern plate 9 and accumulated in a rigid manner so as to form a consolidated layer of molding sand along the surface of the pattern plate 9, while the air is induced through the vent plugs (not shown), the vent bores 10 and the cavities 11 and 4, and is finally discharged to the outside through the evacuation ports 5. (See FIG. 3).

Figure 4:
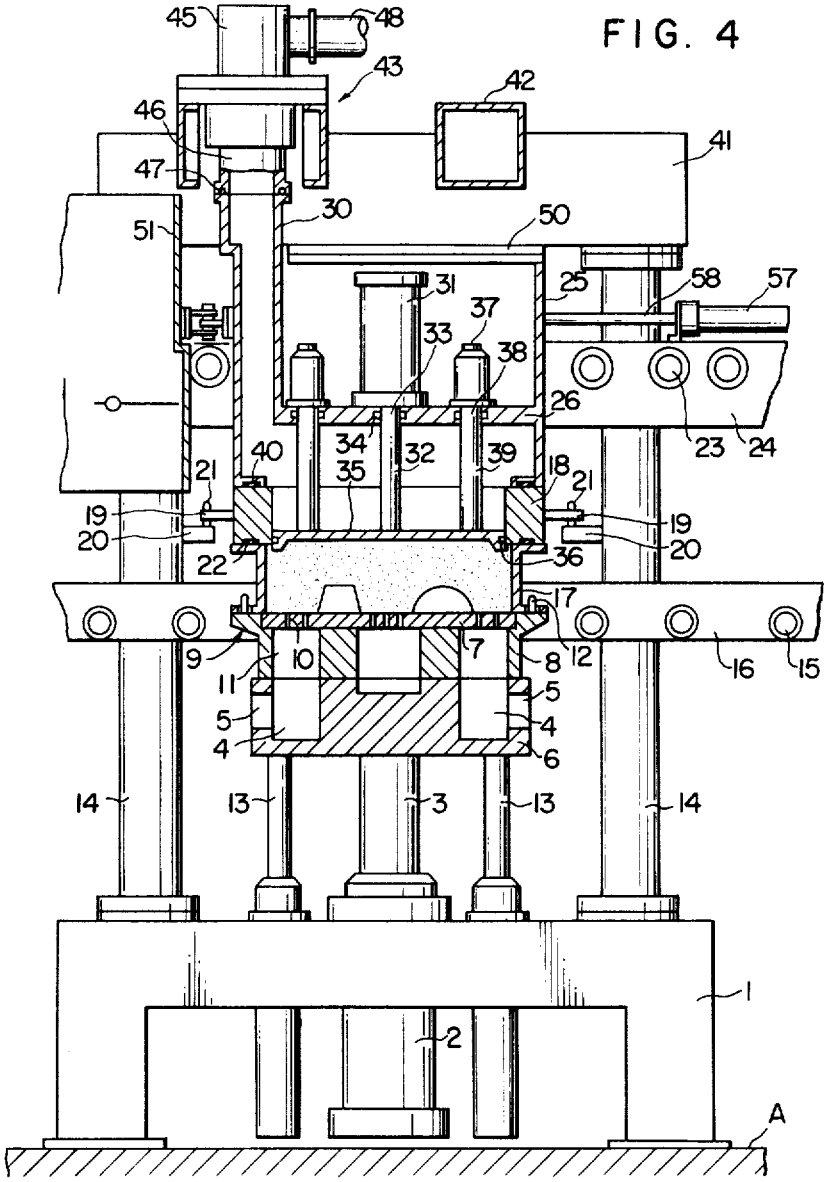

After the compressed-air supply through the air supplying passage 30 over a predetermined time length, the 3-way directional control valve (not shown) is operated to close the air passage so as to stop the air supply. Subsequently, the cylinder 31 is actuated to lower the squeeze plate 35 into the up-set frame while making a sealing contact with the latter through the sealing member 36 as shown in FIG. 4. The lowering of the squeeze plate 35 is temporarily stopped as it comes into contact with the surface of the molding sand filling the molding flask and the up-set frame. In this state, the 3-way directional control valve (not shown) is opened to allow the supply of the compressed air to the closed space defined by the upper surface of the squeeze plate 35, the inner surface of the cover member 25, the partition plate 26 and the up-set frame 18, through the cylinder 45, the hollow piston rod 46, and the air supplying pipe 30.

In consequence, the squeeze plate 35 is depressed to effect a squeeze on the molding sand filling the mold flask 17 and the up-set frame 18 to provide the desired consolidation of the molding sand and the desired molding condition. (See FIG. 4).

As the squeezing operation is completed, the 3-way directional control valve (not shown) is switched to the discharge position so that the compressed air is discharged from the space in the cover member 25. At the same time, the cylinder 31 is reversed to raise the squeeze plate 35. Also, the cylinder 45 of the pressurizing cylinder device 43 is reversed so as to lift the hollow piston 46 to disconnect the latter from the air supplying pipe 30. At the same time, the cylinder 2 is reversed to reset the cover member 25 to the state shown in FIG. 1 in which it is supported through its supports (not shown) by the roller conveyor 24. Also, the up-set frame 18 and the mold flask 17 are reset to the starting position shown in FIG. 1 in which they are carried by the brackets 20 and the roller conveyor 16, respectively.

Then, as the pattern plate 9 is further lowered after it has delivered the mold flask 17 to the roller conveyor 16, the pattern plate 9 is parted from the molding sand.

Meanwhile, the cylinder 57 is reversed and the hopper 51 is refilled with the next batch of the molding sand by a suitable sand supplying device which is not shown, within the period after the starting condition shown in FIG. 1 is obtained and before the mold parting operation is completed. After the completion of the mold parting, the mold flask 17 accommodating herein the formed mold is moved by a shifting means (not shown) in one direction, e.g. to the right, along the roller conveyor 16, and a next vacant mold flask 17 is brought to the position just above the pattern plate. The described operation of the apparatus is performed cyclically to continuously form a large number of molds.

Although the invention has been described through its preferred form, the description made heretofore is not in limiting sense, and it is possible to impart various changes and modifications to the described preferred embodiment.

For instance, the pattern plate 9 may be movable disposed just above the table 6, insteadly of being fixed to the latter. Alternatively, the pattern plate 9 may be arranged such that it carries the mold flask 17 and is placed on the table 6 after the mold flask 17 is charged with the molding sand.

Needless to say, the up-set frame 18 can be neglected, if the mold flask 17 has a sufficient height with respect to the pattern plate.

Since the present invention provides the above-said construction, it is therefore possible, by a supply of the compressed air, to accumulate the molding sand particles finely and in a compacted manner on the surface of the pattern plate, particularly around the area where the vent bores are formed. The mold of desired condition is then formed by a subsequent action of the squeezing device.

Thus, according to the invention, it is possible to eliminate the jolting device and, hence, to prevent the generation of vibration and noise which would adversely affect the environmental condition. The elimination of the jolting mechanism permits a less sturdy construction of the molding apparatus as a whole than the conventional apparatus which must withstand the vibration generated by the jolting device. For the same reason, the size and weight of the molding apparatus are reduced and the scale of the foundation work can be reduced as compared with that for the conventional apparatus. In addition, thanks to the utilization of the compressed air which is made to flow through the molding sand, it becomes possible to use a small cylinder device which can support only the squeeze plate, instead of the cylinder device having a large capacity necessitated by the conventional molding apparatus.

For these reasons, the installation cost of the molding apparatus is greatly reduced.

The supply of the compressed air permits a consolidation or compacting of the mold sand particles on the portions of the pattern plate where the squeezing pressure is less likely to be exerted, i.e. where the vent bores are formed. However, the other portions of the molding sand are not packed in the manner as the jolting operation. It is therefore possible to form a mold having a uniform consolidation with a reduced squeezing force. The reduced squeezing force in turn minimizes the wear of the pattern plate.

It will be seen from the foregoing description that the present invention offers various advantages over the conventional apparatus.

What is claimed is:

1. A molding apparatus comprising:

a pattern plate provided at desired portions thereof with vent bores;

means for moving a mold flask to a position just above said pattern plate;

an up-set frame disposed at a position above said mold flask just above said pattern plate, said upset frame being movable up and down;

a box-shaped cover member having a lower end opening and arranged to displaceably cover the upper opening of said up-set frame;

means for lifting and lowering said pattern plate up and down relatively to said cover member so that said up-set frame and said mold flask brought to said position may be cramped between said cover member and said pattern plate;

an imperforate squeeze plate disposed in said cover member and movable up into and down and out of said cover member through said lower opening thereof, whereby said squeeze plate may be moved down into and up out of said upset frame; and means for supplying a compressed air into the cramped mold flask through said lower end opening of said cover member and through said up-set frame when said squeeze plate has been retracted into said cover member, said means also adapted for supplying a compressed air onto said squeeze plate to impart a squeezing power to said squeeze plate when said squeeze plate has been moved down into said up-set frame.

2. A molding apparatus as claimed in claim 1, wherein said cover member is movable laterally between a first position just above the up-set frame and a second position laterally offset from said first position, said molding apparatus further comprising molding sand supplying means laterally movable between a first position just above said up-set frame and a second position laterally offset from said first position, and means for moving said cover member and said molding sand supplying means alternatingly to respective first positions just above said up-set frame.

3. A molding apparatus as claimed in claim 2, wherein said cover member and said molding sand supplying means are connected to each other and movable in vertical directions relatively to each other.

4. A molding apparatus as claimed in claim 1, wherein said apparatus further comprising a vertically movable table for carrying said pattern plate, said table having bores communicating with said vent bores so as to release and discharge the compressed air from the mold flask to the atmosphere outside of the molding machine.

5. A molding apparatus as claimed in claim 1, wherein both of said pattern plate and said cover member are vertically movable, so that, as said lifting and lowering means are actuated, said lifting and lowering means carries and lifts said mold flask brought to said position above said pattern plate, said mold flask in turn carries and lifts said up-set frame and said up-set frame in turn carries and lifts said cover member, said molding apparatus further comprising a stopper for stopping the upward movement of said cover member.

6. A molding apparatus as claimed in claim 1, further comprising a piston-cylinder device adapted to act only to lower said squeeze plate to a position where said squeeze plate materially engages the inner surface of said up-set frame while the squeezing power on said squeezing plate is wholly derived from the pressure of said compressed air.

7. A molding apparatus as claimed in claim 3, wherein said cover member is provided with a compressed air introduction bore for introducing said compressed air, while said compressed air supplying means include a hollow piston rod communicatable with said source of said compressed air and adapted to be pressed against said compressed air introduction bore and a piston-cylinder device slidably receiving said piston rod.

8. A molding apparatus as claimed in claim 6, wherein said squeeze plate is provided on its peripheral surface with a sealing member for an airtight sealing engagement with the inner surface of said up-set frame.

9. A molding apparatus as claimed in claim 1, wherein a sealing member for an airtight sealing engagement with the upper part of the peripheral wall of said up-set frame is provided around the lower end opening of said cover member.

10. A molding apparatus as claimed in claim 1, wherein a sealing member for an airtight sealing engagement with the upper end portion of the peripheral wall of said mold flask is provided around the lower end opening of said up-set frame.

* * * * *